US006249976B1

(12) United States Patent
Osame

(10) Patent No.: US 6,249,976 B1
(45) Date of Patent: Jun. 26, 2001

(54) SCISSORS

(76) Inventor: Mitsuo Osame, 4-7-12-203, Chiyoda, Sakado, Saitama, 350-0214 (JP)

( * ) Notice: Subject to any disclaimer, the term of this patent is extended or adjusted under 35 U.S.C. 154(b) by 0 days.

(21) Appl. No.: 09/480,629

(22) Filed: Jan. 10, 2000

(30) Foreign Application Priority Data

Feb. 3, 1999 (JP) ..... 11-026702

(51) Int. Cl.[7] ..... B26B 13/12

(52) U.S. Cl. ..... 30/199; 30/248; 30/257; 30/260

(58) Field of Search ..... 30/196, 199, 260, 30/340, 341, 342, 257

(56) References Cited

U.S. PATENT DOCUMENTS

| | | | | |
|---|---|---|---|---|
| 869,949 | * | 11/1907 | Westerdahl | 30/257 |
| 1,093,726 | * | 4/1914 | Pearson | 30/257 |
| 2,587,586 | * | 3/1952 | Bernardi | 30/248 |
| 5,722,171 | * | 3/1998 | Schmidt | 30/260 |

FOREIGN PATENT DOCUMENTS

| | | | | |
|---|---|---|---|---|
| 1058772 | * | 11/1953 | (FR) | 30/257 |

* cited by examiner

*Primary Examiner*—Hwei-Siu Payer
(74) *Attorney, Agent, or Firm*—Rabin & Champagne, P.C.

(57) ABSTRACT

The invention is a scissors in which the direction of blades is changeable with regard to handles. The feature is a pair of cutting implement (5A) and (5B), which is a curved intermediate portion (4) between handles (3) and a pin (6) with a constraint mechanism (13).

4 Claims, 4 Drawing Sheets

SCISSORS

BACKGROUND OF THE INVENTION

1) Field of the Invention

The invention is related to a kind of scissors which is applicable in cutting paper and cloths.

2) Description of the Prior Art

As known, a scissors is a cutting implement having two blades joined by a pin that allows the cutting edges to be opened and closed. Normally, a scissors is used to cut a paper in one direction. Once diversified cutting direction is desired, such as 90 degrees, one has to rotate the paper or change the cutting direction, which is very difficult when the paper is very large or heavy. Also, constant paper cutting is very difficult.

SUMMARY OF THE INVENTION

The invention is a scissors, which is applicable for paper cutting at various directions without any difficulty. To achieve the above objective, the invention includes two cutting implements joined by a pin, which allows the blades and handles of the cutting implements to move. In the design of the invention, a cutting implement includes a blade and handle. The cutting implements are joined by a pin disposed between the blades and handles. With the particular design, the cutting implement allows one to cut along a curved path on a first plane, which is orthogonal to a second plane formed by operating the cutting implement. With the invention, a curved cutting path is reached.

One of the best embodiments of the invention is the application of a cutting implement, which includes a blade and flexible handle. By the joint of the flexible blades, an object in a different form of cutting implement is developed. When an angle desired is reached, it may join the blades to form a constraint mechanism.

Another embodiment of the invention is the application of a cutting implement, which includes a blade and handle. By the joint of flexible blades, a constraint mechanism functions on the basis of gearinlay on blades.

Another embodiment of the invention is the application of a cutting implement, which is located between a pin and handles. By the joint of flexible blades, a constraint mechanism functions on the basis of gear inlay on blades.

DETAILED DESCRIPTION OF THE PREFERRED EMBODIMENT

Figure 1:
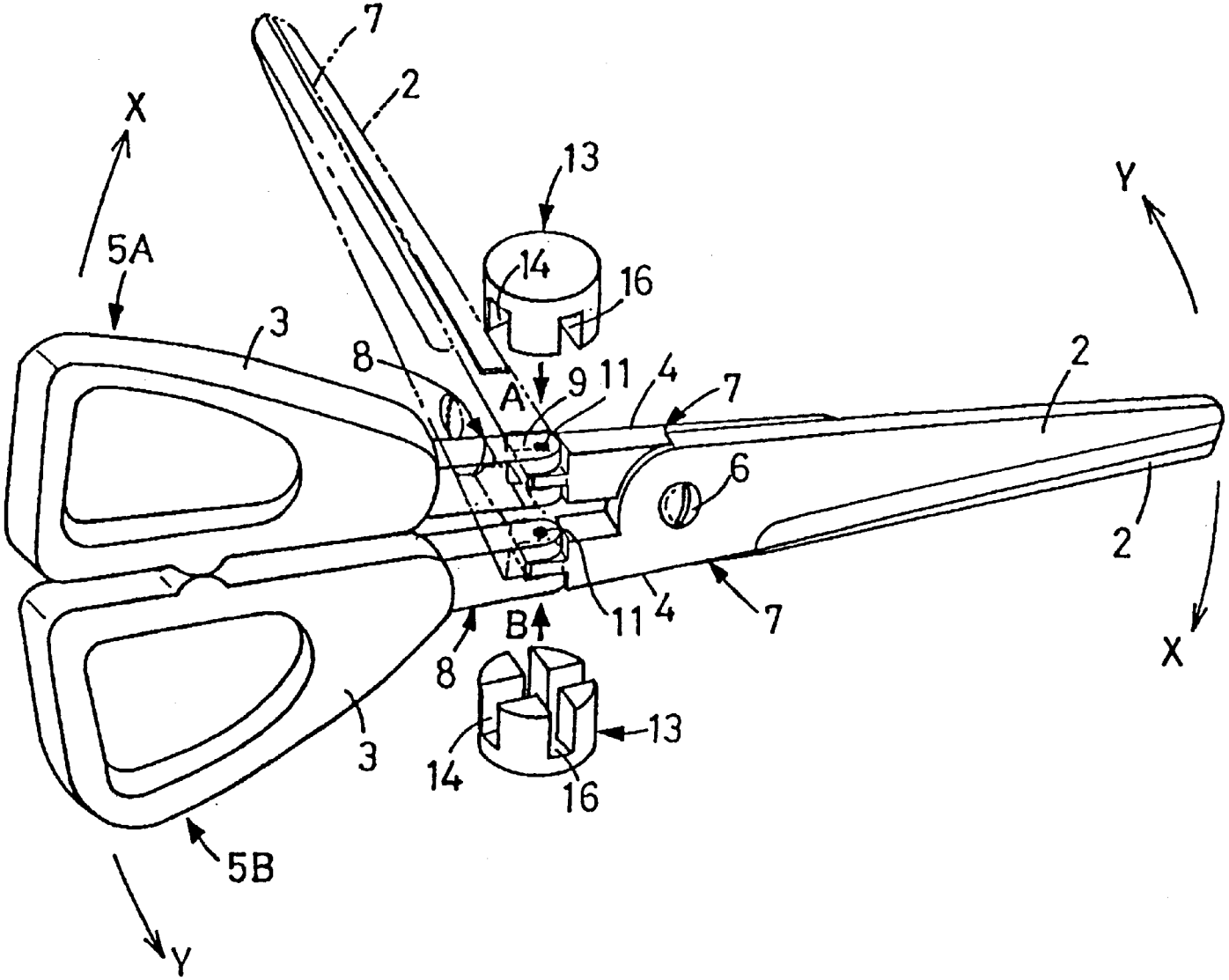
FIG. 1 is an oblique drawing of the invention herein for a scissors.
Figure 2:
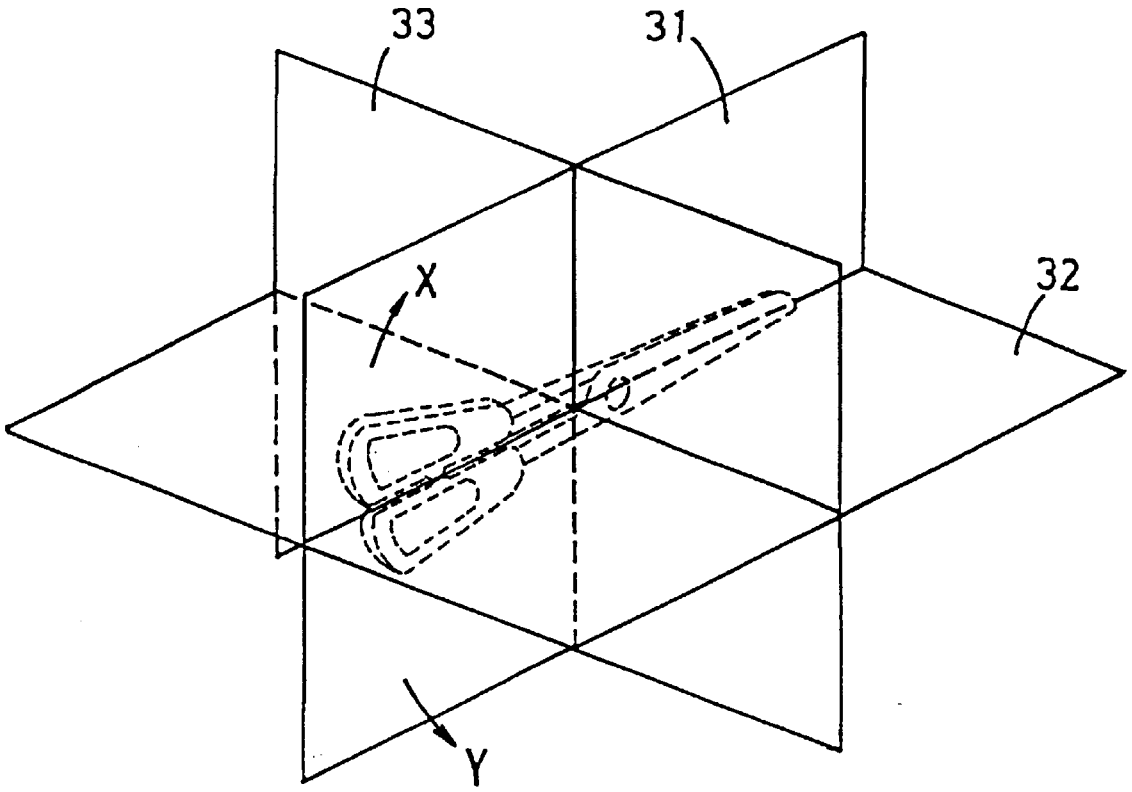
FIG. 2 an oblique drawing of the invention herein for plane 1, 2, and 3.

Referring to the attached figures, the invention of a scissors is detailed below:

FIG. 1 is an oblique drawing of a scissors. FIG. 2 is an oblique drawing in hypothetical plane 31 through 33 of a scissors in a first plane through a third plane formed by the movement of scissors blades. As shown, a scissors is comprised of a pair of cutting implements 5A and 5B. Each cutting implement includes a respective blade 2, handle 3, and intermediate portion 4. Both of the cutting implements 5A and 5B can be pivoted relative to each other about a pin 6 located on the intermediate portion 4. The blade 2 and handle 3 of the cutting implement 5A are rotatable clockwise in an X direction about the rotation axis of pin 6. As illustrated in FIG. 2, within the first hypothetical plane 31, both cutting implements 5A and 5B move on the first hypothetical plane 31. Both cutting implements 5A and 5B at intermediate portion 4 are divided into front end 7 near blades 2 and rear end 8 closer to handle 3. The front end 7 and rear end 8 are joined by a pin 11 on protrusion 9 for rotation. Protrusion 9 is composed of a tongue and groove arrangement, with a groove being formed in a face of rear end 8, and a tongue being formed on a face of front end 7. The tongue is received in the groove to allow rotation. For a scissors located on first hypothetical plane 31, the pin 6 is on the second hypothetical plane 32 extended in a horizontal direction and is orthogonal with the first hypothetical plane 31. Pin 11 is located on first hypothetical plane 31 extended in the orthogonal first hypothetical plane 31. Thus, the front end 7 and rear end 8 can rotate on the second hypothetical plane 32. To both the cutting implement 5A and 5B in FIG. 1, both of the front end 7 and rear end 8 can rotate within the range without collision.

To prevent rotation, front end 7 and rear end 8 are disposed straight. On the particular protrusion 9, a constraint mechanism 13 is installed in the directions of arrow A and B. The constraint mechanism includes the first groove 14 and the second groove 16 which is orthogonal to the first groove. When the front end 7 and rear end 8 are straight, they are disposed within the first groove.

Figure 3:
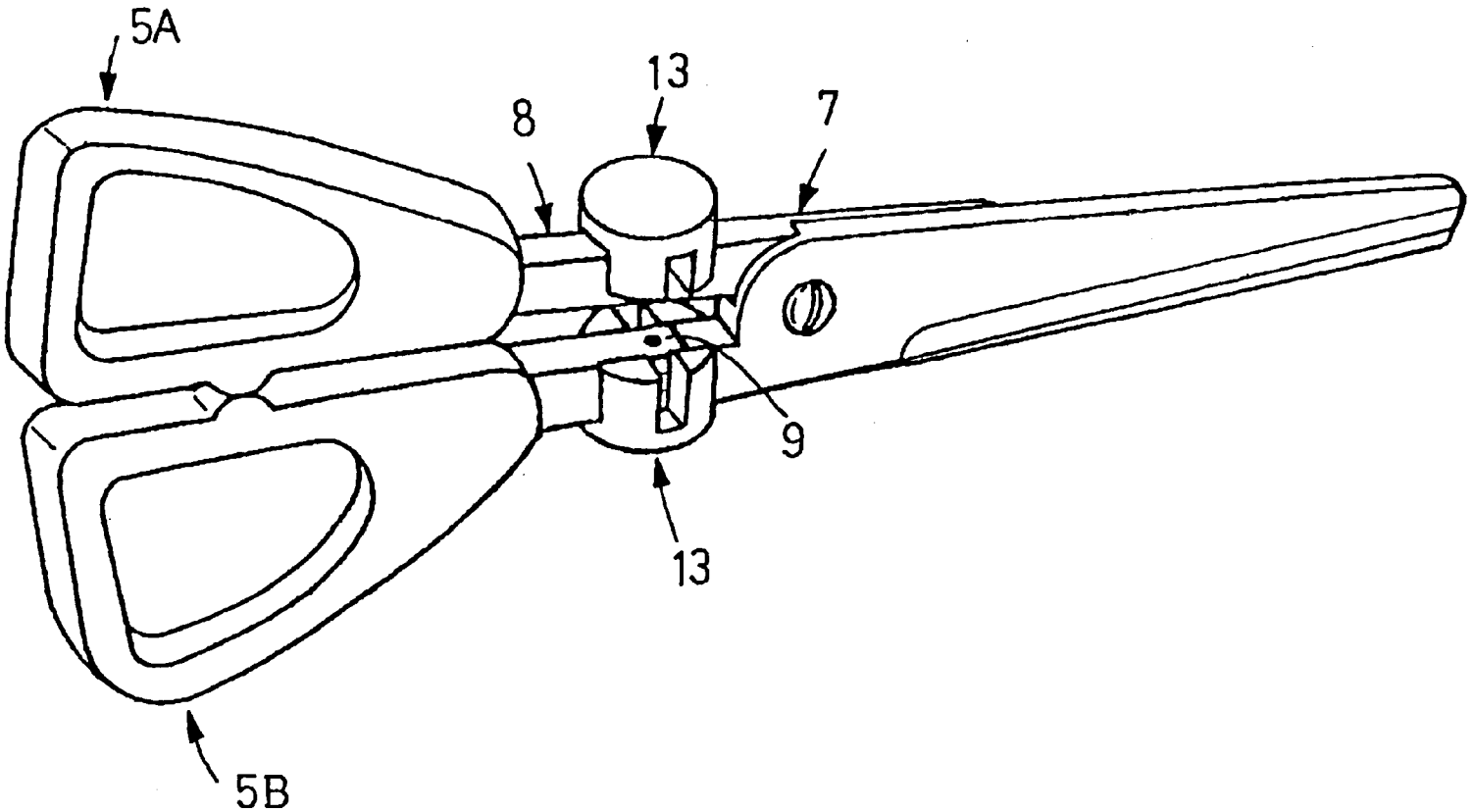
FIG. 3 is a drawing of the invention herein for the plane, which is identical with the FIG. 1 with a constraint mechanism in a condition of gear inlay.

FIG. 3 shows a scissors on a condition that the constraint mechanism 13 is inlayed on protrusion 9. Constraint mechanism 13 prevents front end 7 and rear end 8 from bending at protrusion 9 by respectively crossing front end 7 on cutting implement 5A and 5B to inlay rear end 8. Thus, the invention of a scissors is very different from traditional scissors and is applicable in cutting a paper and cloth.

Moreover, the inlay of constraint mechanism 13 and cutting implement 5A and 5B are shown in FIG. 1 when front end 7 bends in 90 degrees with regard to rear end 8. The curved front end 7 closing protrusion 9 is inlayed within the second groove 16 on the constraint mechanism. The curved rear end 8 closing protrusion 9 is inlayed within the first groove 14. Also, both front end 7 and rear end 8 are inlayed within constraint mechanism 13 on an orthogonal condition to maintain front end 7 and rear end 8 in 90 degrees. Under such condition, handle 3 moves in the direction of arrow X and Y on hypothetical plane 31. On the other hand, in the third hypothetical plane 33 (see FIG. 2) extension which is orthogonal to the first hypothetical plane 31, blade 2 rotates with regard to pin 6. Thus, the scissors in the invention can cut a paper extended in laterally facing direction on the opposite side of handle 3. The constraint mechanism 13 is installed on a relative position of protrusion 9. Because it can be taken apart, a scissors can be applied under the status of FIG. 3 and the hypothetical line in FIG. 3. When cutting a paper in straight, the blade 2 of the scissors in the invention can be bent to change cutting direction without shifting the paper.

Figure 4:
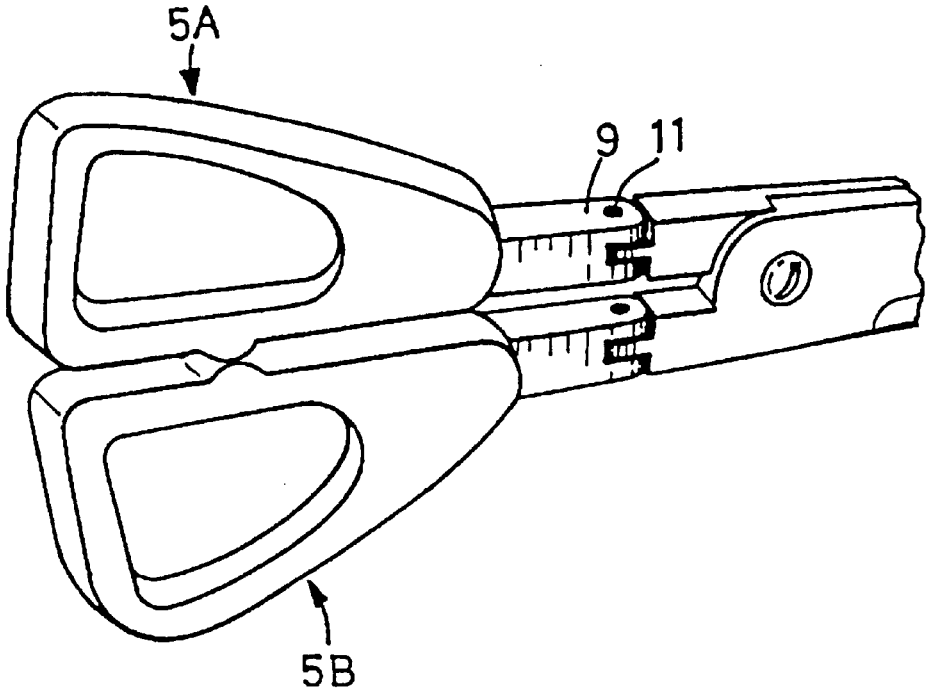
FIG. 4 is another partial drawing of preferred embodiment of the invention.
Figure 5:
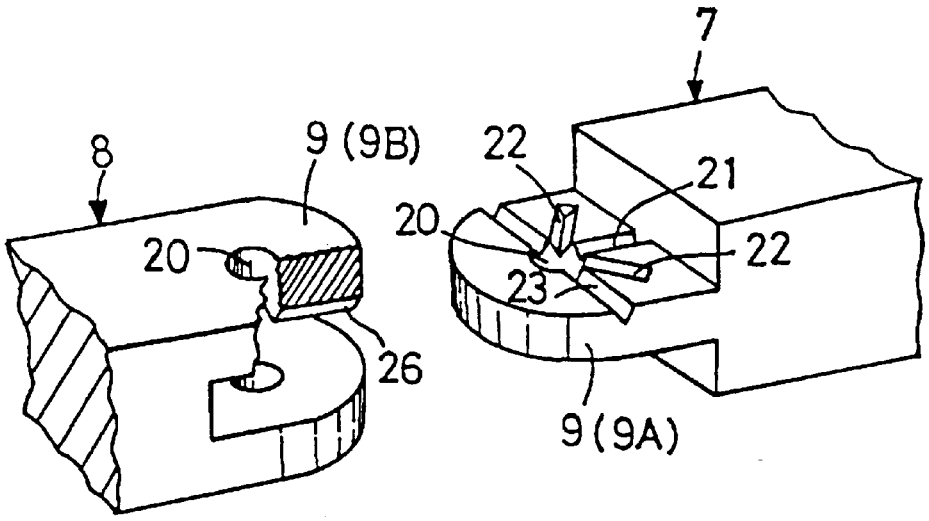
FIG. 5 is an oblique drawing of the invention herein for the blades of a scissors in FIG. 3.

FIG. 4 is another partial drawing of preferred embodiment of the invention. FIG. 5 is an oblique drawing for the protrusion 9 of a scissors of the invention. Although the outlook of protrusion 9 and the portion shown in FIG. 1 are the same, pin 11 on cutting implement 5A and 5B is removed. Front end 7 and rear end 8 are not fixed as shown in FIG. 5. There is a gear mechanism on protrusion 9.

Above front end 7 of protrusion 9A, the first inlay groove 21 extends from the blade pinhole 20 in radial directions heading toward front end 7, the third extended inlay groove 23 is orthogonal to first inlay groove 21, and a second inlay groove 22 extends in the desired angle between inlay groove 21 and inlay groove 23. Protrusion 9B on rear end 8, can be flexibly deformed in either the upper or lower direction as shown in FIG. 5. It forms an extrusion of a downward clip 26 to fasten and release the first through third inlay groove 21 through 23. When front end 7 rotates according to the center of the protrusion with regard to the left or right direction of rear end 8, the downward clip 26 is fastened within the first through third inlay groove 21 through 23. Both of the front end 7 and rear end 8 can be mutually fixed. If the downward clip 26 is stopped on first inlay groove 21, blade 2 is straightly extended in the facing direction. If downward clip 26 is stopped on the third inlay groove 23, blade 2 is laterally extended in the facing direction. If downward clip 26 is stopped on second inlay groove 22, blade 2 is extended in the skew direction. The hypothetical plane formed by the movement of skew blade 2 is located between first hypothetical plane 31 in FIG. 2 and third hypothetical plane 33. With the aid of constraint mechanism 13 and the scissors in the invention, one may further strengthen the fixture of extension direction of blade 2.

Because the scissors in the invention can alter the blade orientation, it is not necessary to shift a paper for any particular direction. The invention provides greater practical performance than products of the prior art. Furthermore, the present invention meets all new patent application requirements and is lawfully submitted for review and the granting of the commensurate patent rights to thereby encourage the spirit of invention and its rightful protection under the patent law.

What is claimed is:

1. A scissors, comprising:

first and second cutting implements pivotably connected together at a first pivot point so that said first and second cutting implements can be pivoted relative to each other in a first direction, each cutting implement including:

a blade on a first side of the pivot point, and a handle on a second side of the pivot point, each cutting implement further being defined by a front end at which the blade is disposed, and a rear end at which the handle is disposed, said front end being pivotably connected to said rear end at a second pivot point so that said front end is pivotable relative to said rear end in a second direction that is perpendicular to the first direction; and a constraint mechanism, said constraint mechanism having first and second grooves crossing each other, said constraint mechanism being removably disposed on at least one of said cutting implements and over said second pivot point so that said front end is disposed in the first groove, and said rear end is selectively disposed in one of said first groove and said second groove, wherein when said front end is disposed in the first groove, and the rear end is disposed in the first groove, said front end is held straight relative to said rear end, and wherein when said front end is disposed in the first groove, and the rear end is disposed in the second groove, said front end is held at an angle relative to said rear end.

2. The scissors recited in claim 1, wherein said front end is pivotally connected to said rear end using a tongue and groove connection.

3. The scissors recited in claim 2, wherein a tongue of said tongue and groove connection is disposed on an extreme end of one of said front end and said rear end, and a groove of said tongue and groove connection is disposed on an extreme end of another one of said front end and said rear end.

4. The scissors recited in claim 3, wherein said groove of said tongue and groove connection has a clip disposed therein, and wherein said tongue has a plurality of grooves formed therein, said clip selectively engaging with a respective groove within said tongue to retain said front end in a selected position relative to said rear end.

* * * * *